United States Patent [19]

Schuermann et al.

[11] 3,930,668

[45] Jan. 6, 1976

[54] STABILIZER FOOT FOR BACKHOES AND THE LIKE

[75] Inventors: Kenneth W. Schuermann; Fred H. Kohman, both of Perry, Okla.

[73] Assignee: The Charles Machine Works, Inc., Perry, Okla.

[22] Filed: Aug. 23, 1974

[21] Appl. No.: 500,188

[52] U.S. Cl. ..... 280/150.5; 212/145

[51] Int. Cl.[2] ..... B60S 9/02

[58] Field of Search ..... 280/150.5; 212/145; 182/108, 109, 111

[56] References Cited

UNITED STATES PATENTS

| | | | |
|---|---|---|---|
| 1,973,226 | 9/1934 | Rose et al. | 182/109 |
| 2,567,989 | 9/1951 | Check | 182/111 |
| 2,623,679 | 12/1952 | Agombar et al. | 182/109 |
| 2,767,898 | 10/1956 | Cramer | 182/109 |
| 2,992,016 | 7/1961 | Pilch | 280/150.5 |

FOREIGN PATENTS OR APPLICATIONS

| | | | |
|---|---|---|---|
| 17,499 | 7/1909 | United Kingdom | 182/109 |

*Primary Examiner*—Leo Friaglia
*Assistant Examiner*—Michael J. Forman

[57] ABSTRACT

A foot for the stabilizer arm of a backhoe or like construction equipment having a plurality of ground-engaging faces suitable for use in stabilizing with different ground surfaces. The foot comprises a detachable pad which may be pivotally attached to the stabilizer arm and retained in selected different orientations, with each orientation providing a different ground-engaging face.

5 Claims, 5 Drawing Figures

8
10
6
2
23
34
12
1
26
24
14
18
46
20
16
24
40
27
25
44
42
46
46
2

8
6
10
23
4
34
12
34
4
21
12
21
14
28
14
16
19
28
26
18
20
19
18
20
22
22
27
25

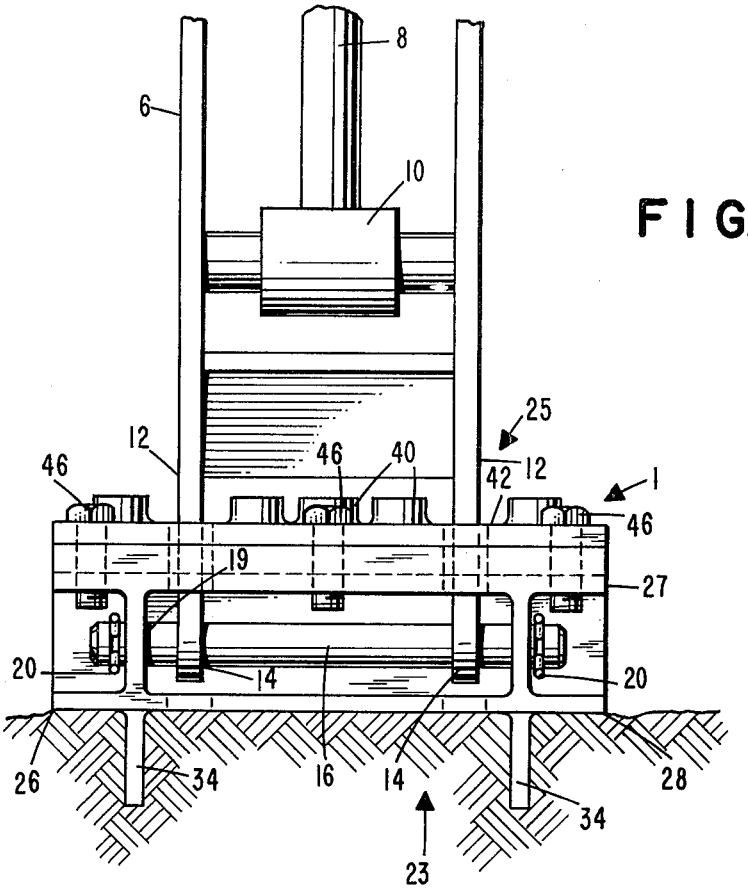
FIG. 3
FIG. 4
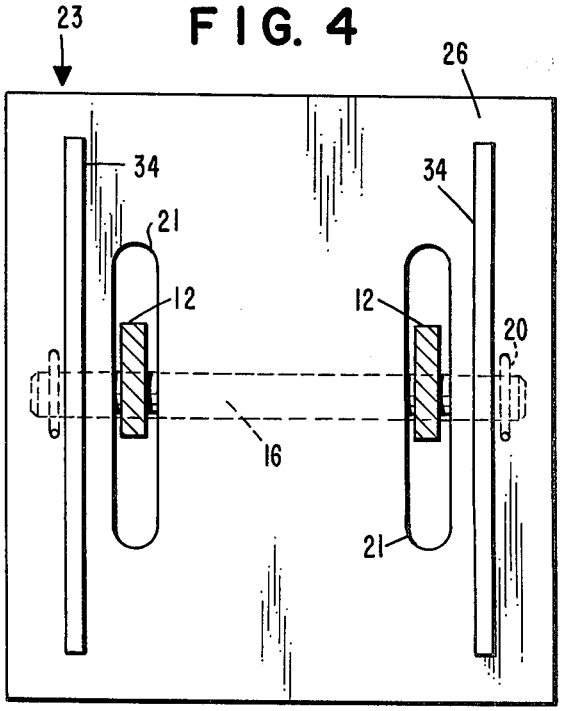
FIG. 5
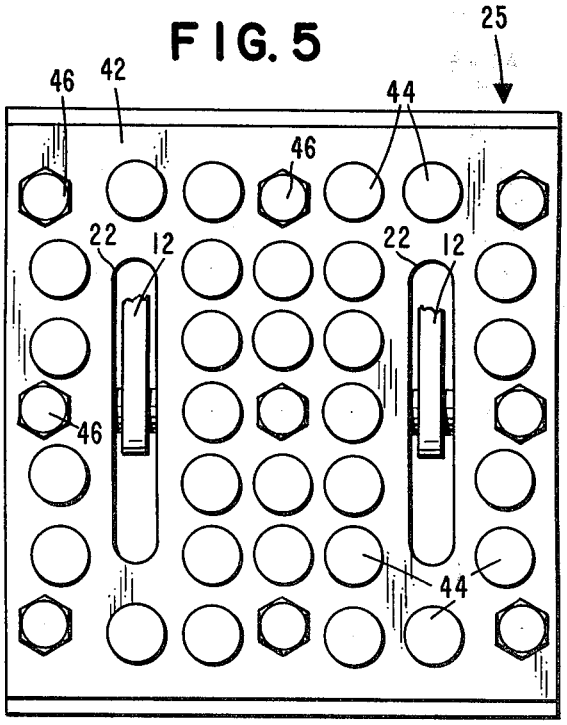

STABILIZER FOOT FOR BACKHOES AND THE LIKE

BACKGROUND OF THE INVENTION

This invention relates to the ground-engaging foot for a stabilizer arm of a backhoe or the like.

It has been common to pivotally mount a pad to the end of a stabilizer arm used on backhoes or the like. Such a pad serves to squarely contact the ground over a relatively large area and to provide improved stability when the backhoe is engaged in a digging operation. Commonly, such a pad has a single ground-engaging face which is flat and nonresilient.

The flat, nonresilient face for use on a ground surface not easily damaged, has sometimes had cleats added to the face. This provides greater stability but can seriously damage pavement surfaces. For use on pavement surfaces where protection is necessary a resilient pad face has been used. Such a resilient face is less likely to dig into and damage pavement and also provides improved adhesion against slippage.

Previous stabilizer foot designs have attempted to provide a capability for changing the pad face to suit ground conditions encountered, providing resilient or nonresilient surfaces or cleats. Such face-changing capabilities have taken the form of separate and interchangeable pads, pads with detachable cleats, and pads with covers for such cleats.

A drawback of all previous changeable pad face designs is that at least one, and perhaps a plurality of discrete parts or components must be added, removed, or interchanged in order to select a new ground-engaging face. This necessitates separate storing facilities for such discrete parts until they are needed or after they have been removed and are not immediately needed. Such extra parts are an inconvenience in the field because they can be easily lost or misplaced and yet must necessarily be available if the face is to be conveniently and readily changed between backhoe stabilizing on pavement or on an earthen surface.

SUMMARY OF THE INVENTION

As distinguished from the prior art, this invention provides a foot for the ground-engaging end of a stabilizing support arm in which the pad has a plurality of faces, each of which has a different ground-engaging characteristic. Any one of the faces may be selected to engage the ground by attaching the pad to the arm in the operative orientation for that particular face. The face in use may be conveniently changed by detaching the pad from the arm and reattaching it in a different orientation but once mounted in a selected oriented position, the removable attaching means and pad construction restrain the pad shifting to a different oriented position.

Accordingly, a primary object of the invention is to provide a foot for a stabilizing arm which provides a capability for conveniently changing the ground-engaging face without the necessity for adding or removing additional parts or interchanging parts.

Another object of the invention is to provide a stabilizing foot pad having a ground-engaging face with cleats for digging into an earthen type ground surface and having a resilient second face for use on pavement.

Another object of the invention is to provide a means for changing the ground-engaging face of the stabilizing foot pad by conveniently reorienting the attachment of the pad to the stabilizing arm.

Other objects, features, and advantages of this invention will readily become apparent from the following detailed description of an illustrative embodiment when considered in connection with the appended drawings.

BRIEF DESCRIPTION OF THE DRAWINGS

FIG. 3 is a front elevational view of the foot with the pad oriented to have the projecting ribbed pad face engage an earthen type ground surface.

FIG. 4 is a top plan view of the projecting ribbed pad face taken along line 4—4 of FIG. 2.

FIG. 5 is a bottom plan view of the resilient pad face.

DESCRIPTION OF AN ILLUSTRATED EMBODIMENT

Figure 1:
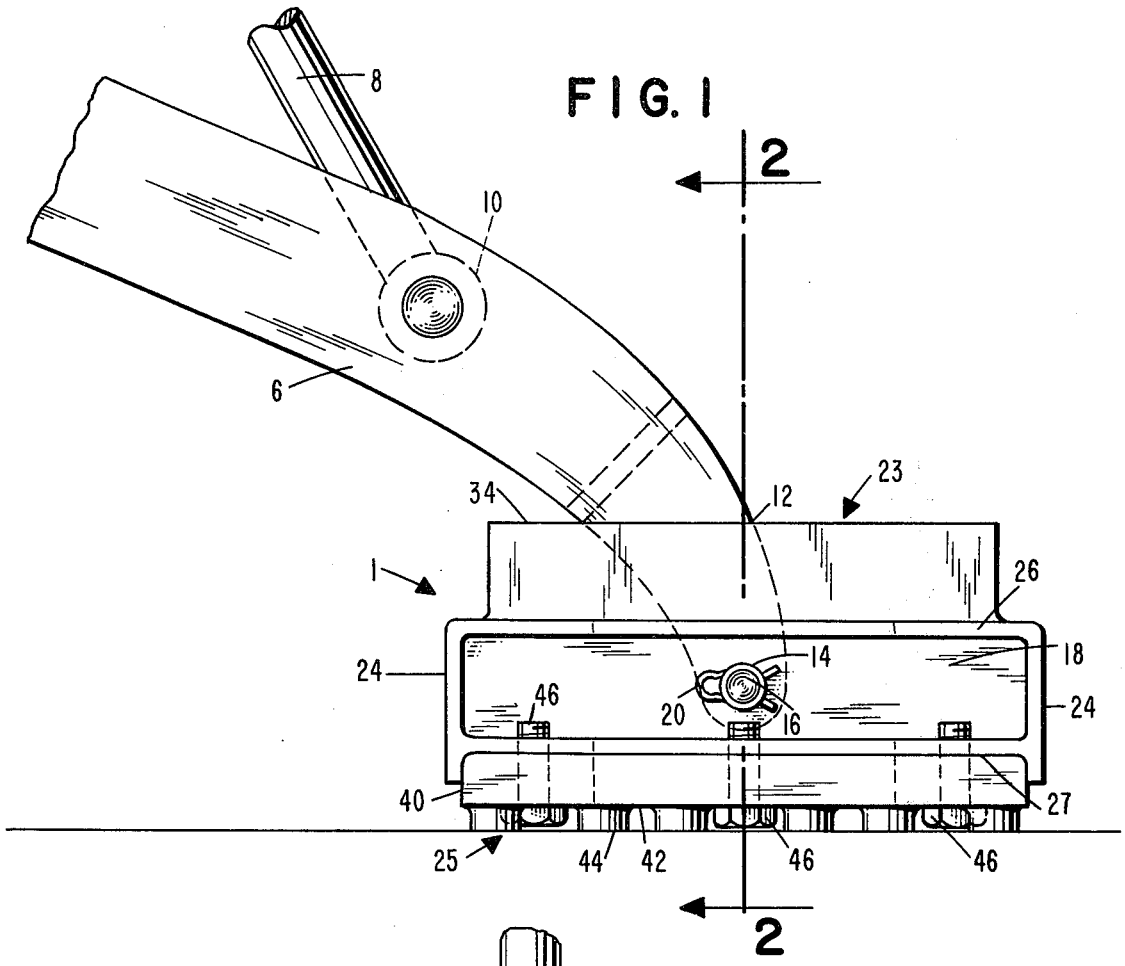
FIG. 1 is a side elevational view of this invention showing a portion of a stabilizing arm connected to the pad and which extends beyond the drawing to its attachment to the backhoe.

As seen in FIG. 1, the foot comprises a pad 1 which is attached to the end of a stabilizing support arm 6 that extends from a pivotal mounting on a backhoe or the like (not shown). The backhoe or other piece of construction equipment on which such stabilizing support arms are used, and the pivotal mounting for the arm 6, are conventional in design and form no part of the present invention. It is common practice for the arm 6 to be raised and lowered by a hydraulic cylinder or other means reciprocating a rod 8 connected to a pivoting connection 10 on arm 6. Such arm raising and lowering means also form no part of this invention.

The pad 1 is attached to the arm 6 by a removable attaching means described below. This permits the pad 1 to be detachably attached to the arm 6 in a plurality of orientations. As described below, in each orientation, only one face of the pad is oriented to engage the ground surface. Therefore, the particular face in use may be conveniently selected and changed by detaching the pad 1 and reattaching it in a different orientation.

The end of the arm 6 has a plurality of spaced fingers 12 with a hole 14 formed near the end of each finger. In the illustrated embodiment, best seen in FIG. 2, two such spaced fingers 12 form the end of the arm 6. The removable attaching means comprises a removable pin 16 which extends through the holes 14 in the fingers 12 and also through holes 19 in a plurality of perpendicular members forming the nonground-engaging sides 18 of the body of pad 1.

The pin 16 has a retaining means at each end to prevent its sliding out of the holes 14 and 19 through which it extends. To enable removal, at least one of the retaining means disposed at either end of the pin 16 is capable of being disabled. Pin designs which would serve this function, having a retainer means which may be disabled, include a bolt with a nut threaded thereon, a cotter pin, or other suitable fasteners. In the illustrative embodiment, pin 16 has an annular groove formed adjacent each of its ends and a resilient retainer clip 20 is disposed in each of these grooves outwardly of the sides 18 of the pad body. The pad 1 is thus attached to the arm 6 by the pin 16 and may be detached from the arm 6 by merely removing either retaining clip 20 and then extracting pin 16 from holes 14 and 19.

The pad 1 has a plurality of ground-engaging faces, each of which forms one side of the pad and is relatively large and substantially flat. Each face has a different configuration providing different surfaces and textures, to accommodate different terrain conditions encountered in stabilizing a backhoe. Nonground-engaging sides 18 are generally perpendicular to the ground and have holes 19 formed at a central point for the purposes of receiving the removable pin 16. In the illustrated embodiment, the pad has two ground-engaging faces 23 and 25 formed on opposite sides of the pad body. The ground-engaging faces 23 and 25 are on two substantially parallel plates 26 and 27 separated by a pair of elongated transverse members 24 which form two exterior sides of the pad and give it the shape of a low, flat rectangular box. The two sides 18 through which the removable pin 16 extends are desirably recessed inwardly of the edges 28 of the parallel plates 26 and 27 to protect the retainer clips 20 or other retaining means from being loosened, damaged, or accidently removed.

Cooperative alignment between the pad 1 and the fingers 12 of arm 6 is established before the holes 14 and 19, through which the pin 16, extends are aligned to receive pin 16. In the illustrated embodiment, such cooperative alignment is achieved by inserting the fingers 12 of the arm 6, through a pair of openings 21 and 22 in the body of the pad 1, into the interior of the pad, thus permitting the removable pin 16 to be inserted through holes 14 in the fingers and holes 19 in the sides 18 of the pad body. Each ground-engaging face 23 and 25 of pad 1 has a pair of elongated openings 21 and 22 which are of a predetermined length to restrain the pad 1 in its selected oriented position when pin 16 is in its pad attaching location. For example, pad face 25 is oriented to engage the ground when the pad is attached with fingers 12 extending through the elongated openings 21 of face 23. Openings 21 and 22 are in a central portion of the opposite faces of the pad, as shown.

The shape of the openings 21 and 22, as seen in FIGS. 4 and 5, is desirable to allow enough clearance between the fingers 12 of arm 6 and the pad 1, which are pivotally attached by means of a removable pin 16, to permit the pad to align itself with the ground surface and afford optimal ground contact over the face. Also, the elongated openings 21 and 22 permit the pad 1 to be attached in either of two positions, depending on the pad face to be used with the ground conditions where the backhoe is to be stabilized. However, the limited length of openings 21 and 22 in the respective faces 23 and 25 restricts the pivotal movement of the pad on fingers 12 of arm 6 so that the desired pad face configuration, selected when the pad is attached by pin 16, cannot inadvertently change in backhoe use as when the stabilizing arms are raised to shift to a new digging location. Change to a different pad surface can only be effected by detaching the pad from arm 6, reversing it and reattaching it to arm 6 by pin 16.

It will, of course, be understood that other attaching means than pin 16, different spacing of the elongated openings and of fingers 12, one or more openings and fingers, etc., may be used. All such variations are within the scope of this invention.

It is emphasized, however, that an important feature of this invention is that the pad is unable to rotate freely between its various orientation positions. It is undesirable to have the pad able to rotate to another and different face configuration each time the stabilizer arm is raised and lowered because constant checking that the desired pad orientation exists would be required. Therefore, pad orientation can only be changed by removal of the pad from the arm and reattachment of the pad to the arm in a different orientation.

One ground-engaging face 23 of the pad 1 comprises a surface of projecting rib members 34 forming cleats which serve to dig into and firmly engage an earthen type ground surface. Such cleats 34 may be disposed in a number of configurations with the projecting members having jagged, pointed, and elongated edge designs. As illustrated, a pair of elongated, parallel projecting rib members 34, forming fins perpendicularly attached to a flat base 26 are proposed. As seen in FIG. 3, the cleats 34 become embedded in and firmly engage the ground surface when the foot is in equipment stabilizing use.

Figure 2:
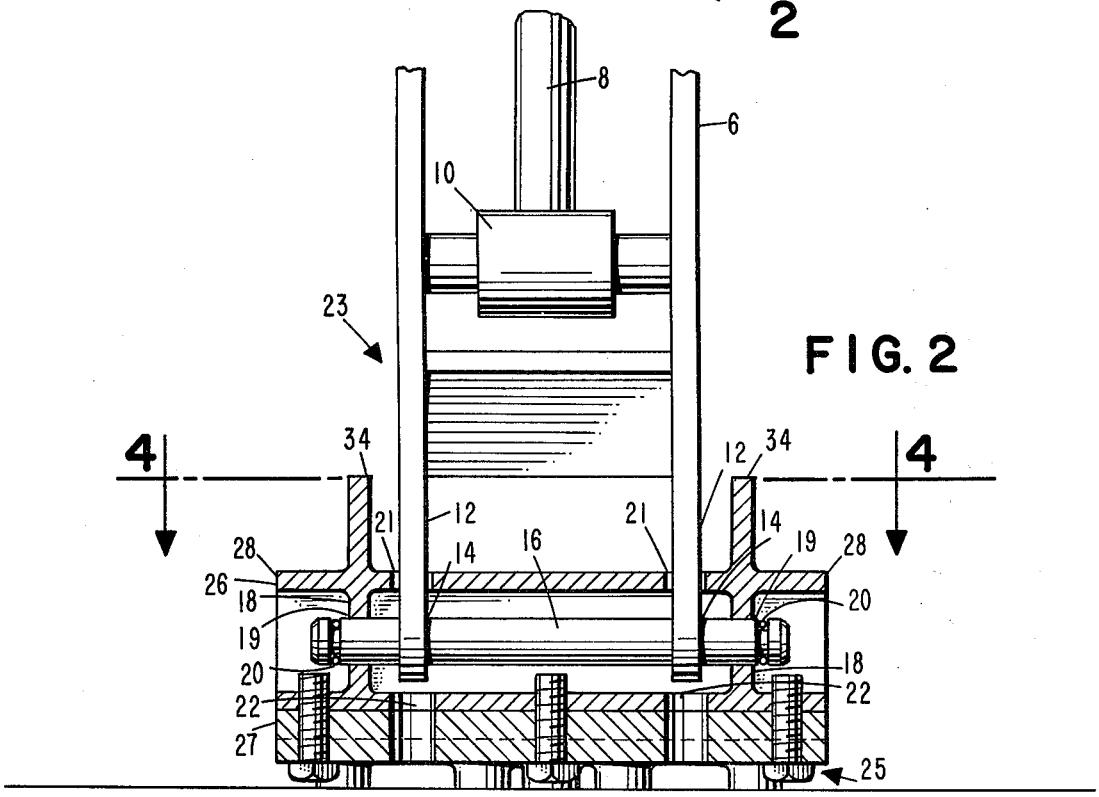
FIG. 2 is a partial front view of the foot with the pad shown in section taken along line 2—2 of FIG. 1.

The second ground-engaging face 25 of pad 1 is substantially flat and used in protecting paved ground surfaces from damage. Thus, a resilient member 40 covering plate 27 between the two exterior sides 24 is removably secured to plate 27 to permit its replacement after substantial wear. Resilient member 40 has a plurality of resilient projections 44 extending from the surface thereof which are in the shape of blunt cylinders and closely spaced on the surface 42, as shown in FIGS. 2 and 5. A plurality of threaded fasteners 46, such as cap screws 46 serve to secure member 40 to plate 27 of the pad. In use, the resilient projections 44 engage the pavement surface to provide a resilient contact between the stabilizing arm 6 and the ground. Thus, they serve to prevent the foot from digging into and damaging a paved ground surface.

The ground-engaging face of the foot is changed by removing pin 16 after removing one or both of the resilient retainer clips 20. Then the pad 1 is slid off the fingers 12 of the stabilizer arm 6 and turned over or reversed when the other ground-engaging surface is to be used in stabilizing the backhoe at different ground conditions. The fingers 12 of arm 6 are then inserted in the pad openings in the face opposite the ground-engaging face to be used. After the holes 14 in fingers 12 and holes 19 in the pad sides 18 are aligned, the pin 16 is inserted and the clip or clips 20 replaced to retain pin 16 in place.

While an illustrative embodiment of this invention has been shown and described along with alternatives in construction, it will be apparent to those skilled in the art that this invention is capable of variation and modification beyond those suggested, so that the scope thereof should be limited only by the scope of the appended claims.

We claim:

1. A foot for the ground engaging end of a stabilizing support arm as employed with earth working construction equipment such as a backhoe comprising:

a pad having a plurality of ground engaging faces, each such face forming one side of said pad and each face having a different ground engaging configuration to accommodate different terrain conditions;

removable attaching means for connecting said pad to the stabilizing support arm in a selected one of a plurality of different orientations where in each of said orientations only one ground engaging face of said pad is retained to be engageable with the ground surface, said removable attaching means including a removable pin means forming an axis to pivotally connect said pad to the stabilizing support arm and permit limited pivoting of said pad relative to the support arm for said pad to align itself with the ground surface it engages and thereby afford optimal ground contact between the surface of the pad and the engaged ground surface;

means on said pad limiting the degree of pivoting of the pad relative to the stabilizing support arm such that in each orientation of said pad only one of said plurality of ground engaging faces is retained in oriented position to engage the ground surface; and said pin means having retaining means thereon to restrict removal of said pin, removal of said pin being required to detach said pad from the stabilizing support arm and enable orientation of said pad to a different selected orientation position whereat said pin means is reinserted and another of said ground engaging faces is pivotally retained to align with the ground surface it engages.

2. A foot for the ground engaging end of a stabilizing support arm as defined in claim 1 wherein said pad comprises one ground engaging face with a substantially flat resilient member detachably mounted to said pad and having a plurality of resilient projections extending therefrom, said resilient member serving to engage a ground surface of pavement without digging into or damaging said pavement; and said pad further comprises a ground engaging face having a pair of parallel projecting rib members perpendicularly mounted on a substantially flat surface which orients said rib members such that they can firmly engage into an earthen ground surface.

3. A foot for the ground-engaging end of a stabilizing support arm as defined in claim 1 wherein said pad further comprises a ground-engaging face having projecting rib members which serve to dig into and firmly engage an earthen ground surface.

4. A foot for the ground-engaging end of a stabilizing support arm as defined in claim 1 wherein one said ground-engaging face comprises:

a resilient member detachably attached to said pad which is suited to engage a ground surface of pavement without digging into and damaging the pavement.

5. A foot for the ground-engaging end of a stabilizing support arm as defined in clam 4 wherein said resilient member has a generally flat ground-engaging surface having a plurality of resilient spaced projections extending from said surface.

* * * * *